US008517189B2

(12) United States Patent
Donohoe

(10) Patent No.: US 8,517,189 B2
(45) Date of Patent: Aug. 27, 2013

(54) SHELVING SYSTEM

(76) Inventor: Mark John Donohoe, Westoning (GB)

( * ) Notice: Subject to any disclaimer, the term of this patent is extended or adjusted under 35 U.S.C. 154(b) by 243 days.

(21) Appl. No.: 12/823,998

(22) Filed: Jun. 25, 2010

(65) Prior Publication Data

US 2010/0326940 A1 Dec. 30, 2010

(30) Foreign Application Priority Data

Jun. 25, 2009 (GB) ..... 0911006.5

(51) Int. Cl.
*A47F 5/08* (2006.01)

(52) U.S. Cl.
USPC ..... 211/90.04; 211/87.01; 248/231.91

(58) Field of Classification Search
USPC ..... 211/90.01–90.04, 87.01, 119.004, 211/118; 248/154, 231.91; 108/180, 193, 108/158.12; 52/36.4
See application file for complete search history.

(56) References Cited

U.S. PATENT DOCUMENTS 1,688,583 A * 10/1928 Horne ..... 211/87.01
3,014,759 A * 12/1961 Bing ..... 297/188.06
3,088,422 A * 5/1963 Kaeslin ..... 108/29
3,201,075 A * 8/1965 Sievers ..... 248/147
3,362,768 A * 1/1968 Fink et al. ..... 312/245
4,150,806 A * 4/1979 Dziuk ..... 248/154
4,165,852 A * 8/1979 Chervenak ..... 248/223.41
4,796,762 A * 1/1989 Law ..... 211/64
4,826,115 A * 5/1989 Novitski ..... 248/224.8
4,873,777 A * 10/1989 Southard ..... 42/94
4,919,280 A * 4/1990 Phillips ..... 211/87.01
4,928,833 A * 5/1990 Huizenga ..... 211/187
5,027,960 A * 7/1991 Rainville ..... 211/118
5,107,995 A * 4/1992 Simpson ..... 211/60.1
5,222,611 A * 6/1993 Wood et al. ..... 211/94.01
5,485,932 A * 1/1996 Romm et al. ..... 211/87.01
5,495,969 A * 3/1996 Cardenas ..... 224/275
5,524,772 A * 6/1996 Simmons ..... 211/4
5,645,178 A * 7/1997 Conley, Jr. ..... 211/87.01
5,746,405 A * 5/1998 Dvorak et al. ..... 248/146
5,810,177 A * 9/1998 Cabiran ..... 211/70.6
5,848,711 A * 12/1998 Schmit ..... 211/90.04
5,855,279 A * 1/1999 Klein et al. ..... 211/35
5,897,086 A * 4/1999 Condon ..... 248/220.1
6,036,149 A * 3/2000 Del Pino et al. ..... 248/231.91
6,042,071 A * 3/2000 Watanabe et al. ..... 248/313
6,050,538 A * 4/2000 Marrow et al. ..... 248/505
6,193,083 B1 * 2/2001 Wood ..... 211/87.01
6,260,489 B1 * 7/2001 Weaver et al. ..... 108/152
6,340,143 B1 * 1/2002 McCraney ..... 248/154
6,405,909 B1 * 6/2002 Burnett et al. ..... 224/275
6,439,517 B1 * 8/2002 Applegate ..... 248/154
6,675,979 B2 * 1/2004 Taylor ..... 211/186
6,681,941 B1 * 1/2004 Johnson ..... 211/86.01
6,698,604 B2 * 3/2004 Denny et al. ..... 211/189
6,726,034 B2 * 4/2004 Holbrook et al. ..... 211/87.01

(Continued)

*Primary Examiner* — Jennifer E Novosad
(74) *Attorney, Agent, or Firm* — Hayes Soloway P.C.

(57) ABSTRACT

A shelving system which includes a plurality of uprights and a plurality of shelves, wherein at least one anchoring device is provided that extends rearwardly from an upright of the anchoring system to anchor under a skirting board. The uprights suitably also have base ends that, from rear to front of the shelving system, slope downwardly whereby the floor-standing shelving system leans rearwardly to lean in toward a wall. This system is ideally suited for ease of assembly and installation by, for example, tenants who have no tools for furniture assembly and drilling of walls and often have no permission to drill walls of their rented house or apartment.

19 Claims, 4 Drawing Sheets

(56) References Cited

U.S. PATENT DOCUMENTS

| | | | | |
|---|---|---|---|---|
| 6,811,038 | B1 * | 11/2004 | Sanderson | 211/13.1 |
| 6,918,499 | B2 * | 7/2005 | De Land et al. | 211/187 |
| 7,261,213 | B2 * | 8/2007 | Strating et al. | 211/87.01 |
| 2003/0010886 | A1 * | 1/2003 | Barnes et al. | 248/680 |
| 2003/0085188 | A1 * | 5/2003 | Klein et al. | 211/118 |
| 2005/0072748 | A1 * | 4/2005 | Shai | 211/87.01 |
| 2005/0121568 | A1 * | 6/2005 | Youngberg | 248/154 |
| 2006/0049124 | A1 * | 3/2006 | Wang | 211/113 |
| 2006/0054577 | A1 * | 3/2006 | Strating et al. | 211/87.01 |
| 2006/0091092 | A1 * | 5/2006 | Vosbikian | 211/87.01 |
| 2006/0243688 | A1 * | 11/2006 | Gilcrest et al. | 211/87.01 |
| 2009/0134296 | A1 * | 5/2009 | Odishoo | 248/231.91 |
| 2010/0133401 | A1 * | 6/2010 | Joseph | 248/231.91 |
| 2011/0017690 | A1 * | 1/2011 | Wang | 211/87.01 |
| 2011/0062301 | A1 * | 3/2011 | Sloan | 248/304 |
| 2011/0068071 | A1 * | 3/2011 | Suman et al. | 211/87.01 |
| 2011/0108687 | A1 * | 5/2011 | Wilson | 248/213.3 |

* cited by examiner

SHELVING SYSTEM

FIELD OF THE INVENTION

The present invention concerns improvements in and relating to shelving systems.

BACKGROUND TO THE INVENTION

The present invention arises from the present applicant's past experiences as a tenant needing to have extensive wall storage for books, files, CDs and a wealth of other articles but being unable to obtain permission to erect wall-anchored shelving or have the landlord upgrade the facilities. The only options available to him thus comprised low height/wide-based space-devouring free-standing book cases and shelving furniture designs, none of which adequately meet the need for slim profile, tall multiple shelf storage. A further problem for tenants when dealing with flat-pack furniture is that they generally do not have their own set of tools and thus would need to acquire tools, such as at least a set of screwdrivers, in order to assemble the average flat-pack furniture kit.

Accordingly it is an object of the present application to provide shelving that is simple to erect and install, suitably without need for tools and without drilling damage to the wall but which can be tall, yet stable, to allow for many shelves and house large numbers of books, files and other articles.

SUMMARY OF THE INVENTION

According to a first aspect of the present invention there is provided a shelving system which comprises a plurality of uprights and a plurality of shelves, wherein at least one anchoring device is provided that extends rearwardly from an upright of the anchoring system to anchor under a skirting board.

Preferably the anchoring device comprises an anchor plate that in use extends rearwardly from at or near the base of the upright to project under a skirting board.

The anchor plate is particularly preferably mounted on the lower end of a strap that is fixed at its top end to an upper part of the upright or the top surface of the upright. The strap is configured such that in use it is under tension and pulls on the anchor plate. The tension of the strap anchored under the skirting board keeps the top of the shelving from tilting forwardly when loads are placed on the shelving or impact the shelving that otherwise would cause a forward turning moment to apply to the shelving.

In a further inventive aspect the uprights have base ends that from rear to front slope downwardly (ie slope down from the rear to the front face of the shelving system) whereby the shelving system will tend to lean rearwardly to lean in toward a wall against which the shelving system is stood in use.

Yet further inventive aspects of the present application will be apparent from the description and claims hereinafter.

BRIEF DESCRIPTION OF THE DRAWINGS

A preferred embodiment of the present invention will now be more particularly described, by way of example only, with reference to the accompanying drawings, in which.

DESCRIPTION OF THE PREFERRED EMBODIMENT

Figure 1:
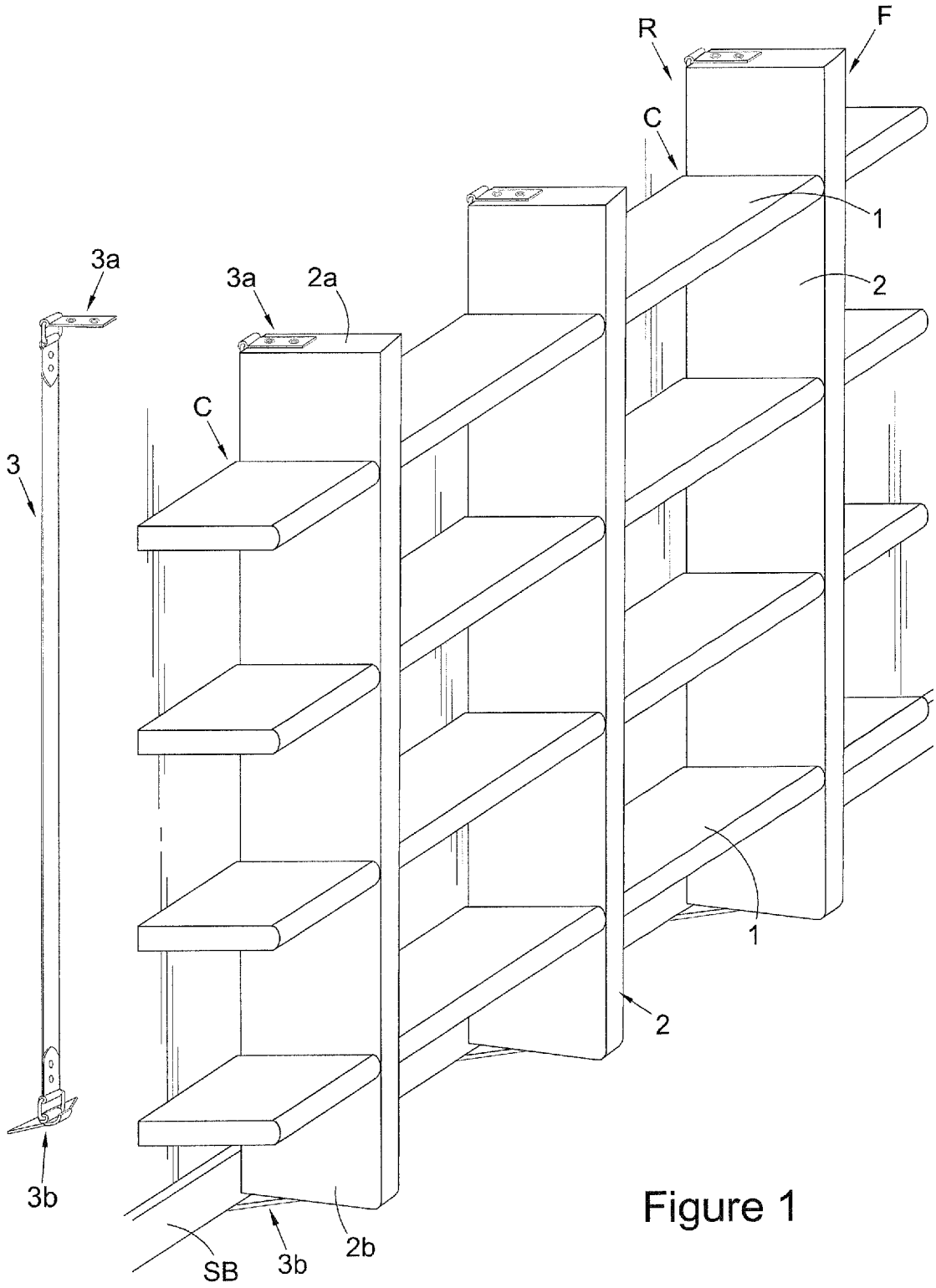
FIG. 1 is a perspective view of the shelving system as assembled and placed floor-standing and leaning against a wall.
Figure 2:
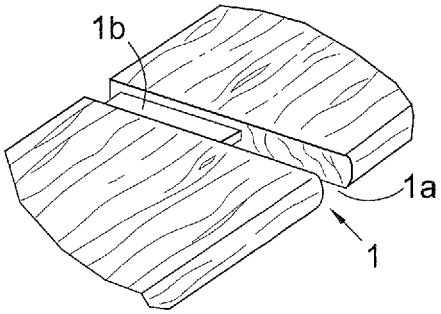
FIG. 2 is a detail perspective view of a shelf of the shelving system illustrating a slotted region of the shelf where it interlocks to an upright.

Referring to FIG. 1, this shows the fully assembled shelving system, here having four plank/board-shaped shelves 1 and three plank/board-shaped uprights 2, standing on a floor and leaning up against a wall of a room in which the shelving is installed.

The rear edge R of each of the uprights 2 at the base 2*b* is pressed hard up to the skirting board SB at the foot of the wall and the back edges of the shelves are pushed hard up against/press against the wall for the full height of the shelving. The shelving if stood away from the wall would lean rearwardly towards the wall and the angle of rearward lean is suitably of the order of 5 to 15° at most and preferably 3 to 10°. However, since the shelving is pushed up against the wall it is held upright/vertical and the tendency to lean provides a turning moment that biases the upper part of the shelving in the direction of the wall, strongly countering any potential forwards toppling forces when the shelving is loaded in use. When pushed hard against the wall the shelving is upright and the shelves are level and true.

Each of the shelves 1 and uprights 2 is suitably formed as a wooden plank or board that has slots at intervals therealong. The shelves 1 and uprights 2 may be machined to the required shape and configuration or may be moulded of plastics or even cast/formed from metal/alloy or composite to have the necessary shape and configuration.

Each of the shelves 1 has an arrangement of three transverse (front edge-to-rear edge) slots 1*a* spaced at intervals therealong, each slot 1*a* to correspond to the location of a respective upright 2 of the shelving system when assembled. The form of each slot 1*a* to is akin to a complete transverse break or gap in the shelf 1 the width of the gap corresponding to the thickness of the upright 2, but it is bridged by a stout bridging member or bridging portion 1*b*of the shelf material so that each shelf retains unity and integrity and can be handled into place on the uprights as one piece. The bridging member or bridging portion 1*b* extends plane parallel to the major faces of the shelf 1 (top and bottom faces, in use) but down-stepped from those faces and runs from just inboard of the rear edge of the shelf 1 to a point about midway toward the front edge of the shelf 1.

Each upright 2 also has a distinctive configuration, with a forwardly down-sloping underside to the base 2*b* and an arrangement of four vertically spaced apart shelf-receiving slots 2*c* in the rear edge R of the upright 2.

The stable nature of the tall, high capacity, slim profile shelving system is substantially contributed by the forwardly down- sloping underside to the base 2*b*. As can be seen in FIG. 1, the angle subtended between the rear edge R of the upright 2 and the underside of the base 2*b* of the upright 2 is obtuse, i.e. greater than 900, while the angle subtended between the front edge F of the upright 2 and the underside of the base 2*b* is acute, i.e. less than 900. This gives the shelving system the effect of having an integral wedge under each upright's foot to tilt/ lean the shelving backwardly and oppose any forwards toppling of the loaded shelving.

A respective anchoring strap 3 extends from an attachment 3*a* to the top part 2*a* of the uprights 2 down the rear edge R of each upright 2 to anchor by a triangular anchoring plate 3*b* under the skirting board SB. The anchor plate 3*b* is pivotally mounted on the lower end of strap 3. The attachment 3*a* at the top end of the strap 3 comprises a plate that is nailed, screwed or bolted to the top of the upright 2. The length of the strap 3 is predetermined to be or adjusted to be such that the strap is under tension and pulls on the anchor plate 3*b* when the anchor plate's rear triangular plate portion is slid under the skirting board SB and it's frontal portion 3*c* catches under the base 2*b* of the upright 2. The tension of the strap 3 anchored under the skirting board SB keeps the top of the shelving from tilting forwardly when loads are placed on the shelving or impact the shelving that otherwise would cause a forward turning moment to apply to the shelving.

The anchoring straps 3 further enhance security of the shelving system against any risk of forward toppling. The user can thus be confident that the shelving system is stable and secure without need for any nailing, screwing or other damage to the mounting wall.

Figure 3:
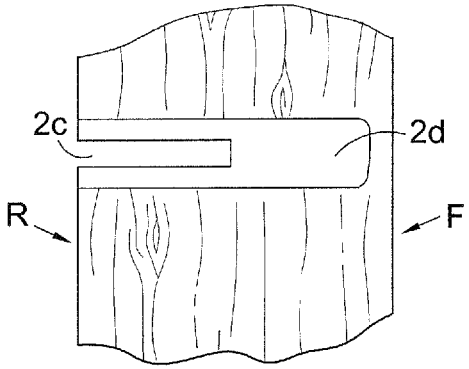
FIG. 3 is a side elevation view of an upright of the shelving system illustrating a laterally recessed rear slotted region of the upright where it interlocks to a shelf.
Figure 4:
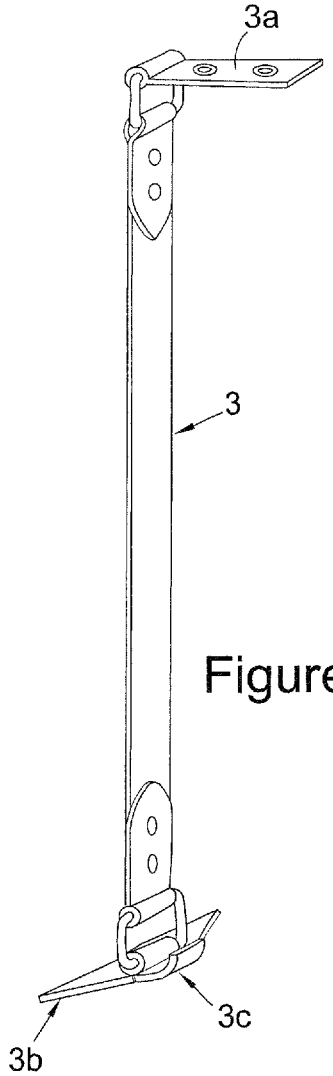
FIG. 4 is a perspective view of an anchoring strap of the shelving system.
Figure 5:
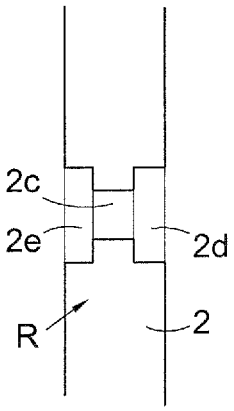
FIG. 5 is a rear elevation view of the slot region of the upright showing the respective recess on each of the lateral major faces of the upright.

Referring to FIGS. 3 and 5, the four vertically spaced shelf-receiving slots 2*c* in the rear edge R of each upright 2 extend from the rear edge R forwardly through the upright 2 to a point approximately half way to the front edge F. Each slot 2 is also flanked by a pair of mutually plane parallel lateral recesses 2*d*, 2*e*, one on each side (major face) of the upright 2 extending from the rear edge R of the upright 2 forwardly to a position just short of the front edge F.

Figure 6:
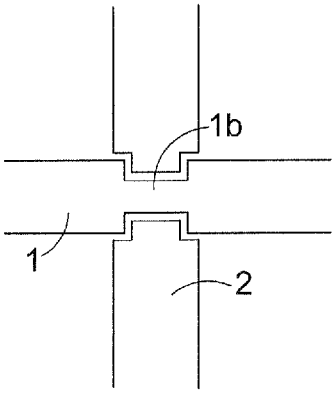
FIG. 6 is a rear elevation view corresponding to FIG. 5 but with shelf fitted to the slot of the upright.
Figure 7:
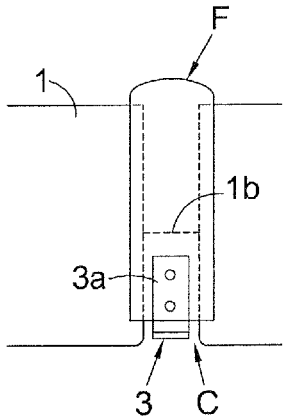
FIG. 7 is a top plan view of the shelving at the slot region/juncture between the upright and top shelf and showing the forward offset of the upright relative to the back face of the shelf defining a recess/channel down the rear edge of the upright.

Referring to FIGS. 6 and 7, the fit of the shelf 1 to the upright 2 is clearly illustrated in those figures. The shelf 1 is simply offered up to the slot 2*c* position in the rear edge R of the upright 2 and slid forwardly so that the bridging member/ portion 1*b* of the shelf 1 is inserted fully into the slot 2*c*. The shelf 1 simultaneously engages in the recesses 2*d*, 2*e* of the upright 2 that flank the slot 2*c* and this provides added support to the shelf 1 from the upright and the combined effect of the inter-meshing formations is that the shelf 1 and upright 2 are solidly inter-locked in vertical and lateral directions, though the shelf 1 may be de-mounted when desired simply by reversing it back out from the upright 2.

Referring to FIG. 7, when fully inserted in the slots 3*c* of the uprights 2, the rears of the shelves 1 project by a distance, suitably of the order of 1 to 3 cm, rearwardly of the rear edges R of the uprights 2 and thus each upright 2 is spaced from the wall at least by that distance when the shelving system is stood up against the wall. This serves as a channel C down which an anchoring strap 3 may neatly pass, bypassing the shelves. Also, the channel may accommodate any electrical power, audio or video cabling or the like for appliances such as stereo, TV lighting, aquarium tank etc. to be held on the shelving. The rearward projection distance of the shelves may suitably further serve to give appropriate clearance of the bases 2*b* of the uprights 2 from the wall to accommodate the skirting board SB.

Figure 8:
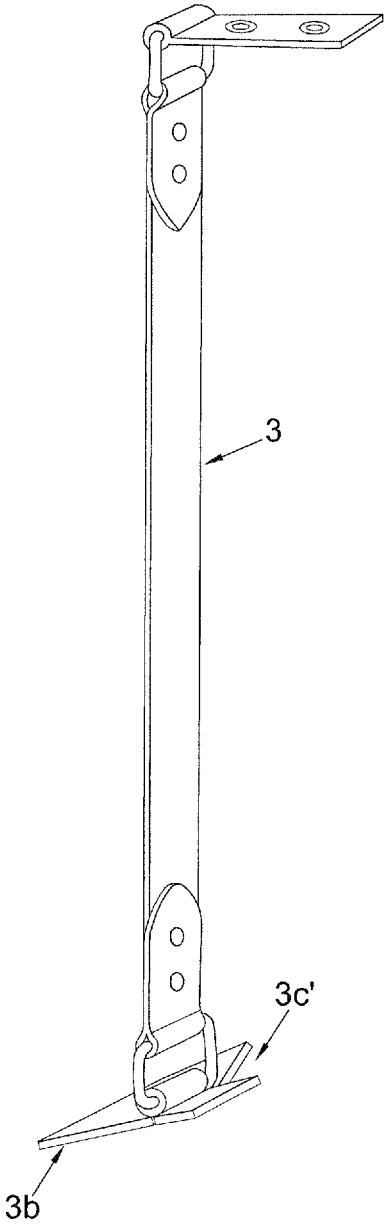
FIG. 8 is a perspective view of a second variant of the anchoring strap of the shelving system.
Figure 9:
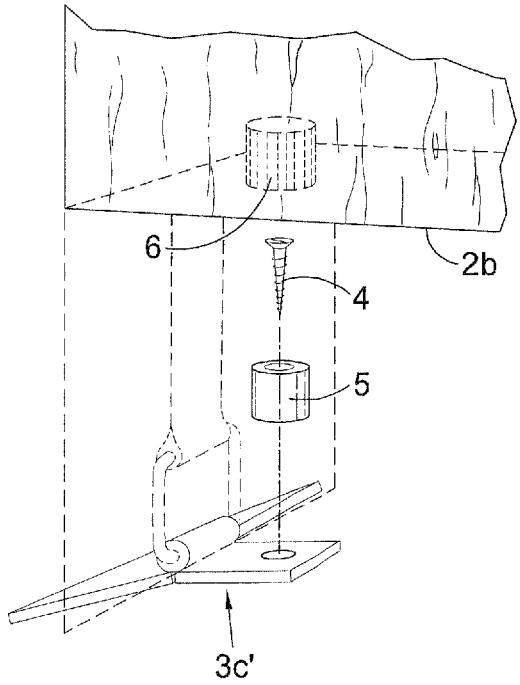
FIG. 9 is a perspective view of the anchor plate of the second variant anchoring strap being secured to flooring and coupled to the underside of an upright.

Referring to FIGS. 8 and 9, in a second variant of the anchoring strap illustrated in those figures, the anchor plate 3*b* of the anchoring strap 3 has a modified frontal portion 3*c'* to eliminate any risk of slippage of the anchor plate 3*b* on slippery floors such as nylon carpets. It may be fastened by a screw 4 or other fixture to the floor (eg to floor boards through carpet) and the upper part of the screw, or a retaining boss 5 or other upstanding feature on the frontal portion 3*c'*, engages into a socket 6 on the underside of the base 2*b* of the upright 2. Other means of releasably coupling the anchor plate 3*b* to the underside of the base 2*b* of the upright 2 may also be used.

Figure 10:
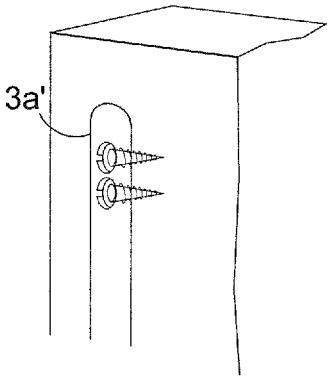
FIG. 10 is a perspective view of the top rear corner of a shelf upright showing an alternative point of attachment for the strap.

Referring to FIG. 10, this shows the top rear corner of shelving upright 2 showing an alternative point of attachment 3*a'* for the strap 3 that is on the rear face of the upright 2 rather than on the top surface 2*a*. Here the preferred form of the main body 30 of the strap 3 is as a metal band such as a steel banding strap as used in the building trade to hold bricks, for example. The strap main body as a steel band is suitably of the order of 10-15 mm wide and of the order of 1 mm thick. The strap of steel or of other metal or metal alloy is suitably riveted at the point of attachment 3*a'* to the upright.

Figure 11:
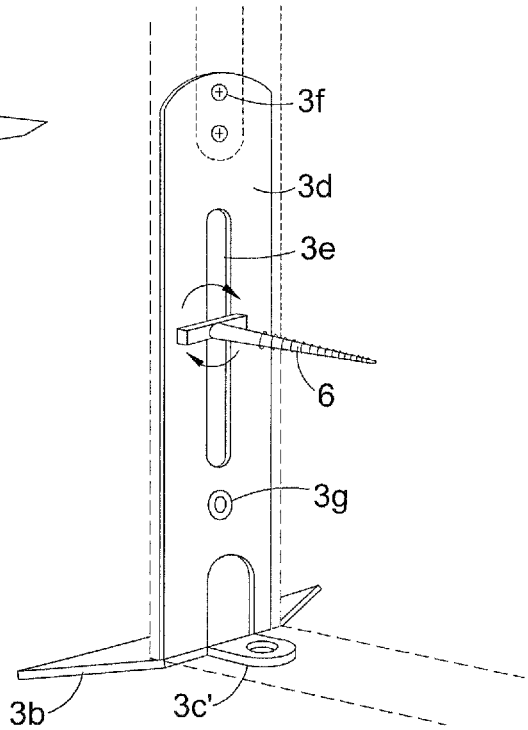
FIG. 11 is a perspective view of the anchor plate of a third variant anchoring strap mounted to an upright.
Figure 12:
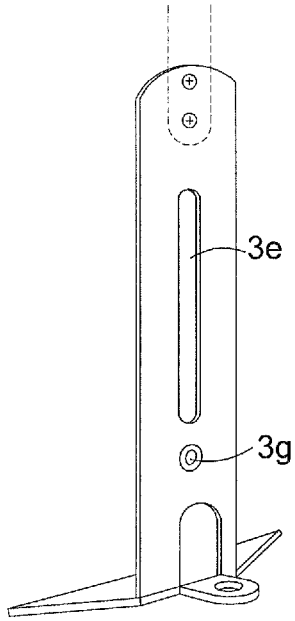
FIG. 12 is a perspective view of the anchor plate of the third variant on its own.

Turning to FIGS. 11 and 12, these show a third variant of the anchoring strap anchoring plate 3*b*, the anchoring plate 3*b* being again fitted against the upright 2 (the upright here being shown in ghost lines). This anchoring plate 3*b* is similar to the preceding one but has a tall upstanding plate portion 3*d* that runs up the rear face of the shelving upright 2 and it is to this that the strap 3 steel banding main body is riveted 3*d* at its lower end. Tall upstanding plate portion 3*d* has an elongate slot 3*e* running up it, substantially vertically up its central axis, and which co-operates with a fixing 6. The fixing 6 suitably is a screw fixing preferably having a T-shaped form, that fixes into the rear face of the shelving upright 2 and serves to hold the upstanding plate portion 3*d* captive on the rear face of the shelving upright 2 but with freedom to move up or down in the slot 3*e*. This captive sliding fastening of the anchoring plate 3*b* to the rear face of the shelving upright 2 provides added security while allowing for uneven flooring.

By using a fixing with a flat T-shaped form it is possible to detach the anchoring plate portion from the rear face of the shelving upright 2 just by turning the fixing 6 through a right angle. If desired, the upstanding plate portion 3*d* may be further provided with at least one fixing aperture 3*g* for a fixing (e.g. screw) that can secure the upstanding plate portion 3*d* to the skirting board SB.

Figure 13:
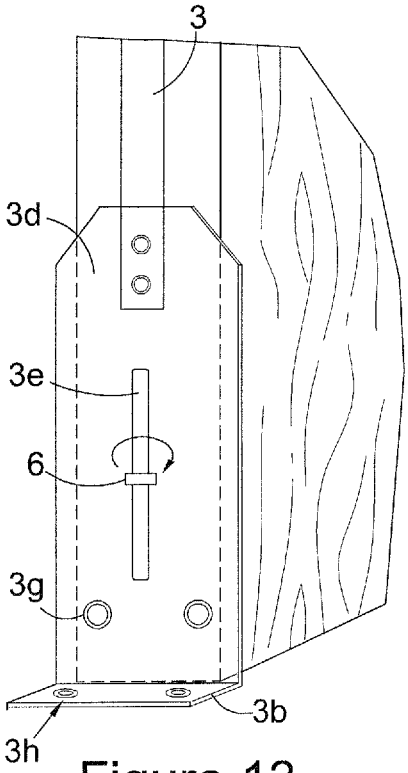
FIG. 13 is a perspective view of the anchor plate of a fourth variant anchoring strap mounted to an upright.
Figure 14:
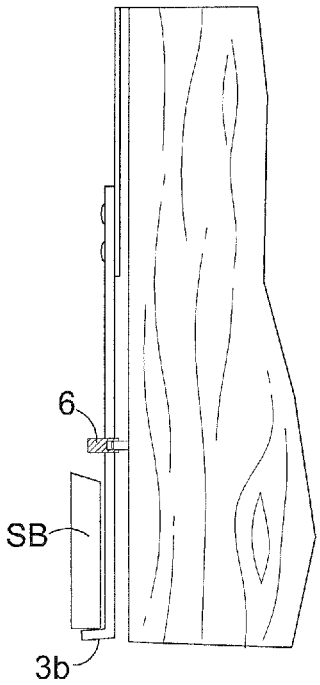
FIG. 14 is a side elevation view of the anchor plate of the fourth variant anchoring strap mounted to an upright.

Turning to FIGS. 13 and 14, these show a fourth variant of the anchoring strap anchoring plate 3*b*, the anchoring strap and plate 3*b* being substantially as per the third variant but notably not having a frontal portion 3*c'*.

The shelving system of the present invention is very simple to erect and install even for flat tenants who have no tools or experience of assembling flat pack furniture. The components comprising the uprights 2 and shelves 1 may be simply slotted together into the matrix form of the assembled book case/ shelving and then placed hard up against a wall. The rearward leaning configuration provides the required stability and security and is enhanced by the use of the skirting board anchoring means/anchoring straps. The wall remains essentially untouched and there is thus not only no need for drilling but also no need for re-touching or filling in any screw/drill holes and no damage to plasterwork of the wall.

The invention claimed is:

1. A floor-standing shelving system installed standing on a floor and against a wall, the wall having a skirting board installed adjacent the floor with a gap between a lower edge of the skirting board and the floor, the shelving system comprising a plurality of uprights and a plurality of vertically spaced shelves supported on the uprights, the system having at least one anchoring device that extends rearwardly from a floor-standing base of an upright of the anchoring system to anchor under the skirting board, wherein the anchoring device comprises a rigid anchor plate that extends rearwardly from at or near the base of the upright and which is inserted under the skirting board and which anchor plate presses upwardly into the underside of the skirting board when the shelving is tilted forwards by a forward tilting force on the shelving to thereby restrain the shelving from tilting over.

2. A shelving system as claimed in claim 1, wherein the anchor plate is mounted on a lower end of a strap that is fixed at its top end to an upper part of the upright or top surface of the upright.

3. A shelving system as claimed in claim 2, wherein the strap comprises a band of a metal or metal alloy that is not ductile/not liable to stretch or break.

4. A shelving system as claimed in claim 2, wherein the anchoring plate is pivotally mounted to the lower end of the strap.

5. A shelving system as claimed in claim 1, wherein the anchoring plate has an upstanding plate portion that runs up a rear face of the shelving upright in use.

6. A shelving system as claimed in claim 5, wherein the upstanding plate portion has a slot that runs up it through which a fixing may pass to hold the anchor plate in a vertically adjustable captive manner against a rear face of the shelving upright in use.

7. A shelving system as claimed in claim 1, wherein the anchor plate has a frontal portion that extends forwardly to project under the upright so that a forward tilting force on the shelving will cause the frontal portion to be urged to tilt and thereby to cause the rear part of the anchor plate to be urged more firmly upwardly into the underside of the skirting board.

8. A shelving system as claimed in claim 7, wherein the anchor plate frontal portion has a releasable coupling to couple to the underside of the base of the upright.

9. A shelving system as claimed in claim 7, wherein the shelving system has an angle of rearward lean of the order of 5 to 15°.

10. A shelving system as claimed in claim 1, wherein the uprights have base ends that from rear to front of the shelving system slope downwardly whereby the floor-standing shelving system leans rearwardly to lean in toward the wall.

11. A shelving system as claimed in claim 1, wherein the shelves and the uprights are slotted to interlock with each other whereby the shelves may be assembled to the uprights and the shelving thus erected without the use of screws, bolts or other fixings.

12. A shelving system as claimed in claim 1, wherein the uprights are shaped as planks or boards that are slotted at intervals vertically therealong with each slot to receive a respective one of the plurality of vertically spaced shelves.

13. A shelving system as claimed in claim 12, wherein each slot is in a rear in use edge of an upright extending forwardly part way toward a front edge of the upright and receives an anchoring strap of the system.

14. A shelving system as claimed in claim 13, wherein each slot extends to a position up to approximately midway toward the front edge of the board.

15. A shelving system as claimed in claim 1, wherein the shelves are each slotted at intervals horizontally therealong corresponding to a spacing of the uprights.

16. A shelving system as claimed in claim 1, wherein the shelves and uprights are be assembled as a matrix structure wherein each shelf sits in a series of aligned slots at a common height up a mutually parallel pair of the uprights whereby it is held vertically and each slot in the shelf locks the shelf to the respective upright locking it against sliding movement in the horizontal plane.

17. A shelving system as claimed in claim 1, wherein the shelves when assembled to the uprights project rearwardly beyond a rear edge of the uprights.

18. A shelving system as claimed in claim 1, wherein the uprights are slotted to interlock with each other whereby the shelves may be assembled to the uprights and the shelving thus erected without the use of screws, bolts or other fixings.

19. A shelving system as claimed in claim 1, wherein the shelves and the uprights are slotted to interlock with each other whereby the shelves may be assembled to the uprights and the shelving thus erected without the use of screws, bolts or other fixings.

* * * * *